United States Patent [19]

Sadler et al.

[11] Patent Number: 4,579,073

[45] Date of Patent: Apr. 1, 1986

[54] INTERCHANGEABLE MOUNTING SYSTEM FOR WEAPON/NAVIGATIONAL UNITS, ETC., ON SHIP-DECKS

[75] Inventors: Karl-Otto Sadler; Willy Schmidt, both of Hamburg, Fed. Rep. of Germany

[73] Assignee: Blohm & Voss AG, Hamburg, Fed. Rep. of Germany

[21] Appl. No.: 621,136

[22] Filed: Jun. 15, 1984

Related U.S. Application Data

[63] Continuation of Ser. No. 347,455, Feb. 10, 1982, abandoned.

[51] Int. Cl.[4] ..... B63B 3/02

[52] U.S. Cl. ..... 114/1; 114/77 R; 89/37.01; 89/41.14

[58] Field of Search ..... 114/1, 4–8, 114/77 R, 364, 85; 52/606, 461, 573, 574, 202, 455–456; 434/195–196, 205, 208, 403, 259; 46/93, 95, 96. 17; 89/37.01, 37.12, 37.13, 41.14, 36.13, 36.12

[56] References Cited

U.S. PATENT DOCUMENTS

| | | | |
|---|---|---|---|
| 1,033,403 | 7/1912 | Hough | 114/201 R |
| 1,591,554 | 7/1926 | Guion | 46/17 X |
| 2,086,989 | 7/1937 | Raad | 52/606 X |
| 2,494,469 | 1/1950 | Booth | 434/196 |
| 2,747,324 | 5/1956 | Zalkind | 46/17 |
| 2,774,150 | 12/1956 | Genin | 434/259 |
| 3,566,742 | 3/1971 | Bemiss | 89/40 |
| 4,031,838 | 6/1977 | Schmidt et al. | 89/37 R X |
| 4,476,798 | 10/1984 | Backus | 114/77 R |

*Primary Examiner*—Stephen C. Bentley
*Assistant Examiner*—John S. Maples
*Attorney, Agent, or Firm*—Nils H. Ljungman

[57] ABSTRACT

Rectangular base mounting-platform structures for removable combat-equipment, for example, guns and other support units like radar which are mounted on rectangular openings on a ship-deck, are provided with interchangeability. In order to achieve interchangeability of units which have mounting-platform structures of unequal size, the platform rectangular dimensions as well as the dimensions of the corresponding rectangular openings are so designed that the base length of the smallest unit is made equal to the width of the next bigger rectangle and so forth; in order to mount the smallest rectangular base on the immediate next larger rectangular opening, the length of the smallest rectangular base is aligned with the width of the larger opening; mounting is so done as to leave an open space towards only one side, leaving only one longer side of the smallest rectangular base unsupported within the area of the mounting opening. The unsupported side is supported by a beam running under the mounting opening, which beam transfers the load to other structure which reinforces the rectangular opening. An area of the rectangular opening which is thus left uncovered is covered by a suitable covering member. The mounting of the rectangular base structure, and the covering member, as well as the ends of the beam, are provided with sealing members to render the platform-structure impervious. Three consecutive rectangular sizes are preferred wherein the width of a rectangle is the same as the length of the immediate smaller rectangle.

35 Claims, 12 Drawing Figures

INTERCHANGEABLE MOUNTING SYSTEM FOR WEAPON/NAVIGATIONAL UNITS, ETC., ON SHIP-DECKS

This is a continuation of the U.S. application Ser. No. 347,455, filed on Feb. 10, 1982, now abandoned.

FIELD OF THE INVENTION

This invention generally relates to providing interchangeability of mounting for removable weapons, navigation units, etc., (herein called "units"), on ship-decks, and more particularly it concerns an interchangeable mounting system for ship-decks to provide the flexibility of being able to mount different size units (with rectangular base structures) on more than one size of opening on the ship-deck. The "units" referred to include units such as fire-control units, lighting systems, instruments and control equipment, radar, hoists and winches, to mention a few. Owing to size considerations and varying functional requirements such as the extent of anchorage needed, these units of different types are built with different base structures for mounting purposes. The base structures are generally of rectangular configuration and necessitate corresponding rectangular openings in the ship-deck for mounting and subsequent monitoring purposes.

BACKGROUND OF THE INVENTION

There is often a need for relocating a functional unit of one particular size and type in a different location on the deck which has a rectangular opening that is perhaps larger and is intended for some other type of unit. An example of such need is one wherein the functions fulfilled by the units in various locations on a ship-deck have to be changed because of a change in strategy or a different approach or even simply to improve the efficiency of the layout of the several units on the ship-deck, depending on particular circumstances. There may also be need for installing a smaller readily available unit in a larger opening on a ship-deck, pending arrival of the proper unit. Yet another situation is encountered wherein units may have to be relocated from a smaller ship to a larger ship where the mounting facilities for the functional units may be different.

Invariably, the functional units have an integral base in the form of a platform structure, and the openings on the ship-decks have reinforcing substructures around the perimeter of the openings for stiffening purposes.

DESCRIPTION OF PRIOR ART

In a known integral platform-substructure system of this type (DE-PS No. 20 56 069), a single type of an integral substructure and an integral platform is provided to receive different systems. However, it is often necessary or useful to arrange openings of different sizes in the hull because in some areas, a large opening is needed to house a bulky system, whereas at other areas, there is no room for such a large opening. For example, in small PT boats, only smaller openings can be provided for integral substructures than in larger ships (for example, destroyers). It must also be taken into account that openings of equal size cannot always be provided at different areas on the same ship to accommodate integral substructures and integral platforms. The present invention is directed at devising an integral platform-substructure system of the aforementioned type that permits openings of different sizes to be used while providing for the most universal possible interchangeability of the integral platform supporting the system.

OUTLINE OF THE INVENTION

To solve this problem in accordance with the invention, the larger of the rectangular integral substructures, of which there are at least two of different sizes, has a width equal to the length of the smaller integral substructure. With this design, an integral platform just large enough to fill the opening of a smaller integral substructure can be installed crosswise in the opening of the next-larger integral substructure. It is therefore possible, for example, to install a weapon with a small integral platform, designed for a PT boat, on a larger ship in which integral substructures with a width chosen in accordance with the invention are present. Thus, it is possible to provide integral substructure types graduated in terms of surface area and related with each other according to their length and width in such a way that the platform of the next-smaller integral substructure type fits sideways into the next-larger integral substructure type.

The invention in its broad form comprises a mounting arrangement on ship-decks for mounting removable prefabricated equipment having different sized integral rectangular base platform-structures which can be mounted at rectangular openings on the ship decks, the equipment being of the type to include units such as a weapon, fire-control unit, a radar unit, lighting or navigation unit and associated instrument control units, the arrangement consisting in an interchangeable mounting system wherein a relatively smaller rectangular base platform structure of a unit can be mounted in a noncorresponding larger rectangular opening, the arrangement comprising: a first size of rectangular base platform structure having a known length l and known width b, said first base platform structure having a corresponding size of rectangular openings in the deck; and at least a second size of rectangular base platform structure having a known length l' and a known width b', wherein said second size platform structure also has a corresponding size of rectangular openings in the deck; the length l of the first size being equal to the width b' of the second size, whereby a unit having a base structure of said first size can be mounted with its base length along the width of a larger second size rectangular opening.

It is particularly advantageous if three integral substructures are provided in the system of the invention, and the width of the next larger is equal to the length of the next smaller in each case. The invention is based on the fact that a three-step graduation of the integral substructure dimensions is sufficient for all practical purposes on the types of ships actually used.

In this way, relatively great universality in practical use can be guaranteed with only three integral substructures of different sizes, and it is possible to interchange platforms among the different integral substructures within the scope of the invention.

When used on ships of different sizes, smaller rectangular integral substructures are assigned to the large ship in each case, in accordance with the invention. However, it is also possible to provide at least two rectangular integral substructures of graduated sizes in accordance with the invention on the same ship.

In other words, smaller ships, such as, for example, PT boats, have several small rectangular openings, but they all have the same dimensions. A larger ship, for example, a destroyer, has a somewhat larger opening whose width is equal to the length of the openings in the smaller ship.

It does happen, however, that openings of different sizes are arranged in the same ship. In this case as well, the system of the invention can easily be used.

Although correspondingly large integral platforms will be set primarily in the larger integral substructures, it is possible to place an integral platform intended for the next-smaller integral substructure into at least one of the larger integral substructures. This may be advantageous, for example, if the weapon provided with the large integral platform is not yet ready, and a weapon mounted on a smaller integral platform must be used during the transition. It is quite possible to install the weapon mounted on the smaller platform not only temporarily but permanently in the larger integral substructure.

If a smaller platform is installed sideways in a larger integral substructure, there is initially no support on one side. The forces exerted at that side are therefore not absorbed by the integral substructure, which could be problematic particularly if a heavy system were arranged on the platform. In this case, in accordance with the invention, an intermediate beam member is inserted between the two long sides of the integral substructure to support the free long side of the integral platform, and its side facing the integral platform is designed to correspond to the integral substructure, and its end regions lying on the integral substructure are designed to correspond to the support areas of the integral platform. The integral substructure is therefore supplemented by the intermediate member on the initially free side of the integral platform.

When a small integral platform is used in a larger integral substructure, the opening remaining beside the integral platform is preferably covered by a rectangular cover; this is advantageous at least in terms of achieving a water-tight seal on the deck around the integral platform.

However, it is particularly advantageous to use the cover in combination with the intermediate member by designing the support areas of the cover to accommodate the support regions of the integral platform and the side of the intermediate member facing the cover to accommodate the integral substructure.

In addition, it is advantageous for the intermediate member to have a width such that the integral substructure formation is provided at its upper longitudinal edges with the two end regions designed to accommodate the support region of the integral platform arranged between them.

Although it is essentially sufficient if the cover guarantees only watertightness and forms a strong floor that withstands pedestrian traffic, in an advantageous refinement, the cover can also support a system, for example, a fire control or lighting system associated with the weapon arranged on the corresponding platform. The system may extend both upward above the cover and downward amidships. Other instruments associated with the weapon or other system can be mounted on the cover. In other words, the cover can also form a type of integral platform itself.

An advantageous practical feature of the invention is in the fact that expediently an intermediate beam member has an upper flange plate, and mounting flanges are provided on the integral platform or on the cover around it and lie opposite the flange plate or a counterflange arranged around the integral substructure, so that the anchoring flanges can be connected to the flange plate or counterflange by bolts.

It is advantageous for the intermediate beam member to be hollow and to have mounting apertures on the bottom, through which the bolts or nuts can be manipulated manually or by a tool.

A particularly favorable design is characterized by the fact that the intermediate member consists of two hollow beams abutting against each other at a flat vertical side wall and having cross sections that are symmetrical to each other, relative to their contact plane. This design is very economical to produce and has high stability.

To permit proper connection between the integral substructure and the intermediate member, the latter has preferably a height corresponding to the height of the vertical wall provided on the integral substructure, and the intermediate member has end walls that can be connected to the vertical wall by bolts. In this way, the intermediate member is fastened and secured completely in the integral substructure and practically forms a component thereof.

In accordance with the invention, the integral substructure has a particularly advantageous design consisting of the fact that the integral substructures and/or integral platform and/or intermediate members have recesses into which the support areas of the integral platform and/or cover of the intermediate member, which are of complementary shapes, extend, with a plastic layer between them. This design is applicable independently of the special dimensioning of the integral substructures and the arrangement of the intermediate member.

By means of an anchoring flanges, counterflanges and an upper flange plate, it is possible not only to accomplish permanent attachment of the platforms or the cover, but also to adjust the integral platform and, if necessary, the cover, relative to the datum plane of the ship by means of adjustment bolts on the components, for instance as taught in accordance with the prior art German Pat. No. 20 56 069, referred to supra.

BRIEF DESCRIPTION OF DRAWING

A more detailed understanding of the invention may be had from the following description of exemplary embodiments to be understood in conjunction with the accompanying drawings wherein.

DESCRIPTION OF PREFERRED EMBODIMENTS

Figure 1:
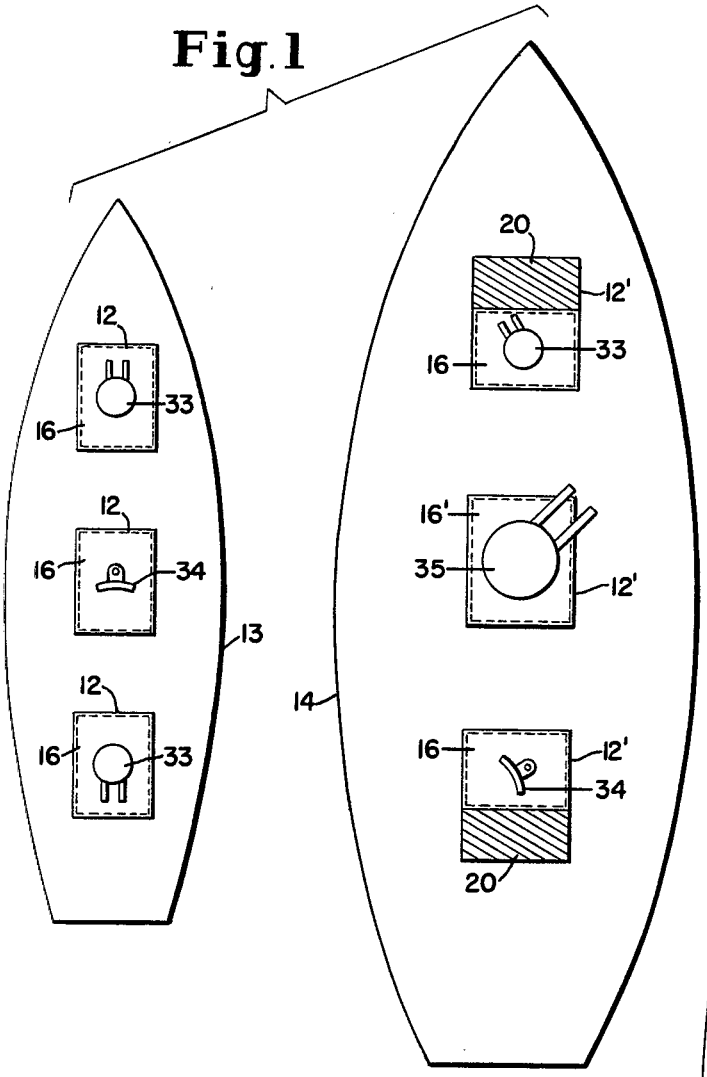
FIG. 1 is a schematic top view of two ships of different sizes, in which the integral platform-substructure system of the invention is used with two different integral substructure openings chosen in accordance with the invention.
Figure 3:
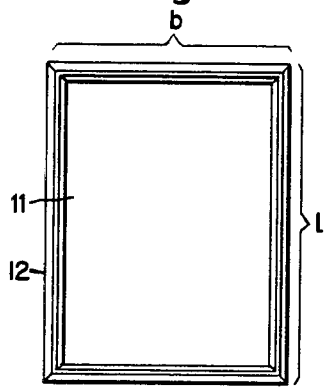
FIG. 3 is a top view of an integral substructure without its platform, provided for a small ship.

According to FIG. 1, three integral substructures 12 are arranged one behind the other along the fore-aft line, as shown on an enlarged scale in FIG. 3. Each integral substructure 12 surrounds a hatch-like opening 11.

Figure 4:
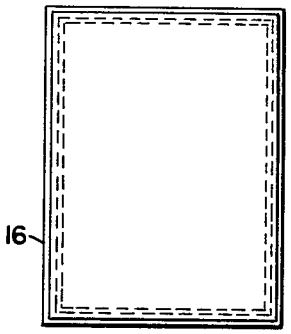
FIG. 4 is a schematic top view of the platform to be fitted on the integral substructure shown in FIG. 3, without the system mounted.

An integral platform 16 of essentially the same dimensions as shown in FIG. 4 on an enlarged scale is set on each of the three integral substructures 12. According to FIG. 1, the front platform carries a gun 33—illustrated schematically —, the middle integral platform 16 carries a schematic-illustrated navigation instrument 34, and the rear integral platform 16 also carries a gun 33. In the schematic representation of FIG. 4, the systems and instruments borne by the integral platform 16 are omitted for the sake of simplicity. While the guns 33 and the navigation equipment 34 extend upward over the deck of the ship, instruments such as, electronic equipment and the like, may be attached to the bottom side of an integral platform 16 and can be associated with systems 33, 34.

Figure 5:
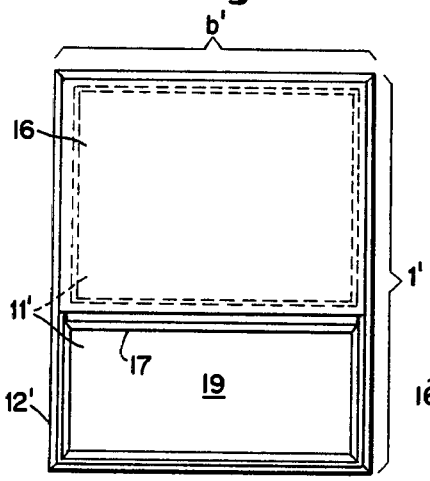
FIG. 5 is a top view of an integral substructure provided for a somewhat larger ship, with the intermediate member and the platform of FIG. 3 mounted crosswise.

In the right half of FIG. 1, is seen a large ship in which three large integral substructures 12', as shown in detail in the enlarged representation of FIG. 5, are arranged one after the other along the fore-aft line.

Figure 6:
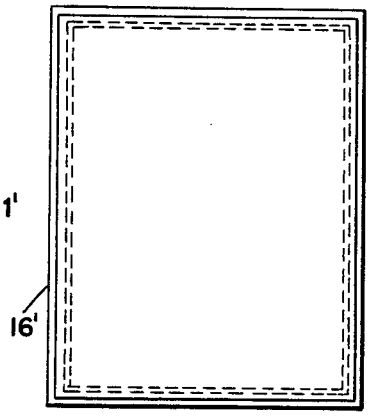
FIG. 6 is a top view of a platform corresponding in size to the integral substructure shown in FIG. 5, without the system mounted.

An integral platform 16', of equal size and bearing a larger gun 35, is set on the middle integral substructure 12'. The integral platform 16' is enlarged in FIG. 6, without the gun 35 mounted on it.

As is particularly evident in FIGS. 3–6, the integral substructures 12, 12' and integral platforms 16, 16' are rectangular with width b and b' and lengths l and l'. In accordance with the invention, the width b' of the larger integral substructure 12' and the larger integral platform 16' are equal to the length l of the smaller integral substructure 12 on smaller integral platform 16, respectively. In the special example shown here, the width b is 3 m, the length l is 4 m, the width b' is 4 m, and the length l' is 5 m. In all, this gives a ratio of 3:4 and 4:5, respectively.

On the basis of this dimensioning of the openings 11, 11', surrounded by the integral substructures, in accordance with the invention, it is possible to set the smaller integral platform 16 across the larger integral substructure 12', as shown in FIG. 5, with an intermediate member 17 inserted bridging the two long sides of the larger integral substructure 12' to support the platform 16 at its free side.

Located next to the integral platform 16, which is adjacent to a narrow side of the integral substructure 12', is a rectangular opening 19, which can be used to assemble and disassemble equipment arranged amidships and is preferably sealed by a cover 20, which is represented schematically in the right half of FIG. 1.

According to FIG. 1, an integral platform 16 is inserted crosswise in the front and rear integral substructure 12' of the large ship 14 and is intended essentially for the smaller integral substructures 12 of the smaller ship 13. The free space (19 in FIG. 5) next to the integral platform 16 is, as stated above, sealed by the cover 20.

Figure 2:
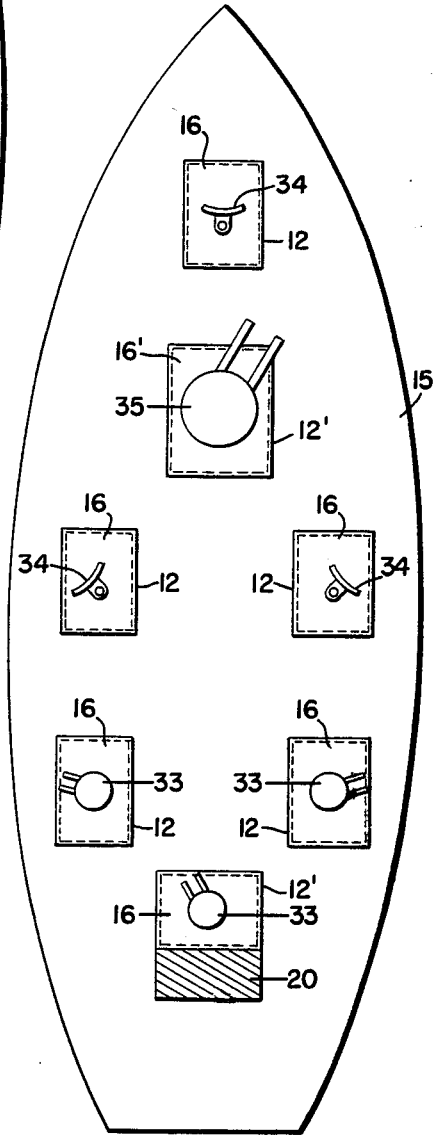
FIG. 2 is a schematic top view of a medium-sized ship in which two integral substructure types of different sizes, in accordance with the invention, are provided.

While FIG. 1 illustrates the application of the system of the invention to two ships 13, 14 of different sizes, FIG. 2 shows that the system can also be used advantageously in a single ship 15.

Two large integral substructures 12', as shown in FIG. 5, are provided in the midship. Furthermore, a total of five small integral substructures 12 are situated in the bow of the ship and at the sides between the two large integral substructures 12'.

Integral platforms 16 of corresponding size are arranged on the small integral substructures 12 and carry small guns 33 and navigation equipment 34.

The larger front integral substructure 12' supports an integral platform 16' of corresponding size with a large gun 35 mounted on it.

However, in accordance with the invention, a small platform 16 with a small gun 33 mounted thereon is installed crosswise in the large integral substructure 12' in the ship's stern. The remaining opening 19 (FIG. 5) is again closed by a cover 20.

The invention also permits combinations between the arrangement of large integral substructures on a single ship or on several ships of different sizes.

Figure 7:
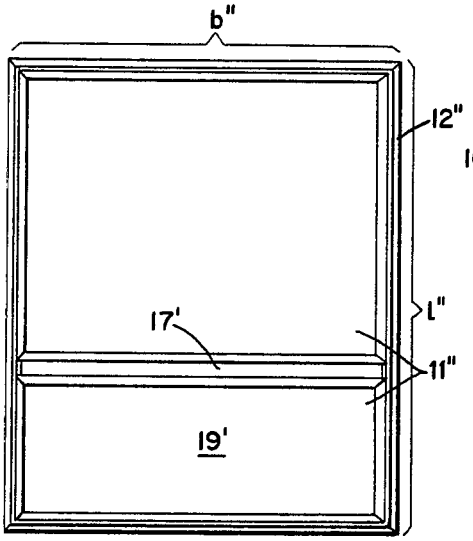
FIG. 7 is a top view of the next-larger integral substructure in the graduated scale of the invention, with the intermediate member installed.
Figure 8:
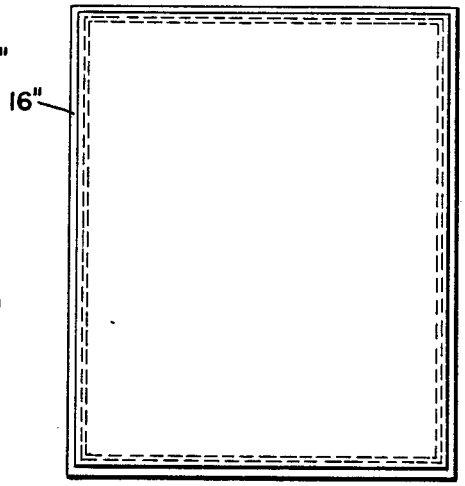
FIG. 8 is a top view of the integral platform corresponding in size to an integral substructure as shown in FIG. 7, without the system arranged on it.

FIGS. 7 and 8 show another somewhat larger type of integral substructure 12'' or integral platform 16''. The hatch-like opening 11'', surrounded by the integral substructure 12'', is also rectangular and, in accordance with the invention, is provided with a width b'', which is equal to the length l' of the next-smaller integral substructure 12'. The large integral platform 16'', with matching dimensions, can be set on the largest of the three integral substructures, that is, substructure 12'' (after the intermediate member 17' is removed) and can in turn accommodate a correspondingly large system. In one example, the length 1'' is 6 m and the width b'' is 5 m. Here as well, only the ratio 6:5 is important.

Figure 9:
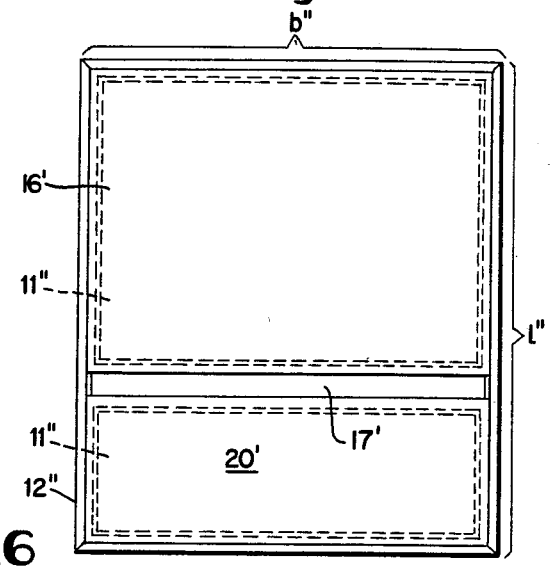
FIG. 9 is a top view corresponding to FIG. 7, but with the integral platform of FIG. 6 set on the integral substructure and the intermediate member.

After the somewhat longer intermediate member 17' (FIG. 7) is installed, it is also possible to install the next-smaller integral platform 16' crosswise on the integral substructure 12'' (FIG. 9) in such a way that the one long side of the integral platform 16' lies on one narrow side of the integral substructure 12', while the other long side is supported by the intermediate member 17'. The remaining opening 19' is closed by a corresponding large cover 20'.

FIGS. 4–9 show an integral substructure-platform system that is graduated in three steps in accordance with the invention and is sufficient for all practical purposes.

Figure 10:
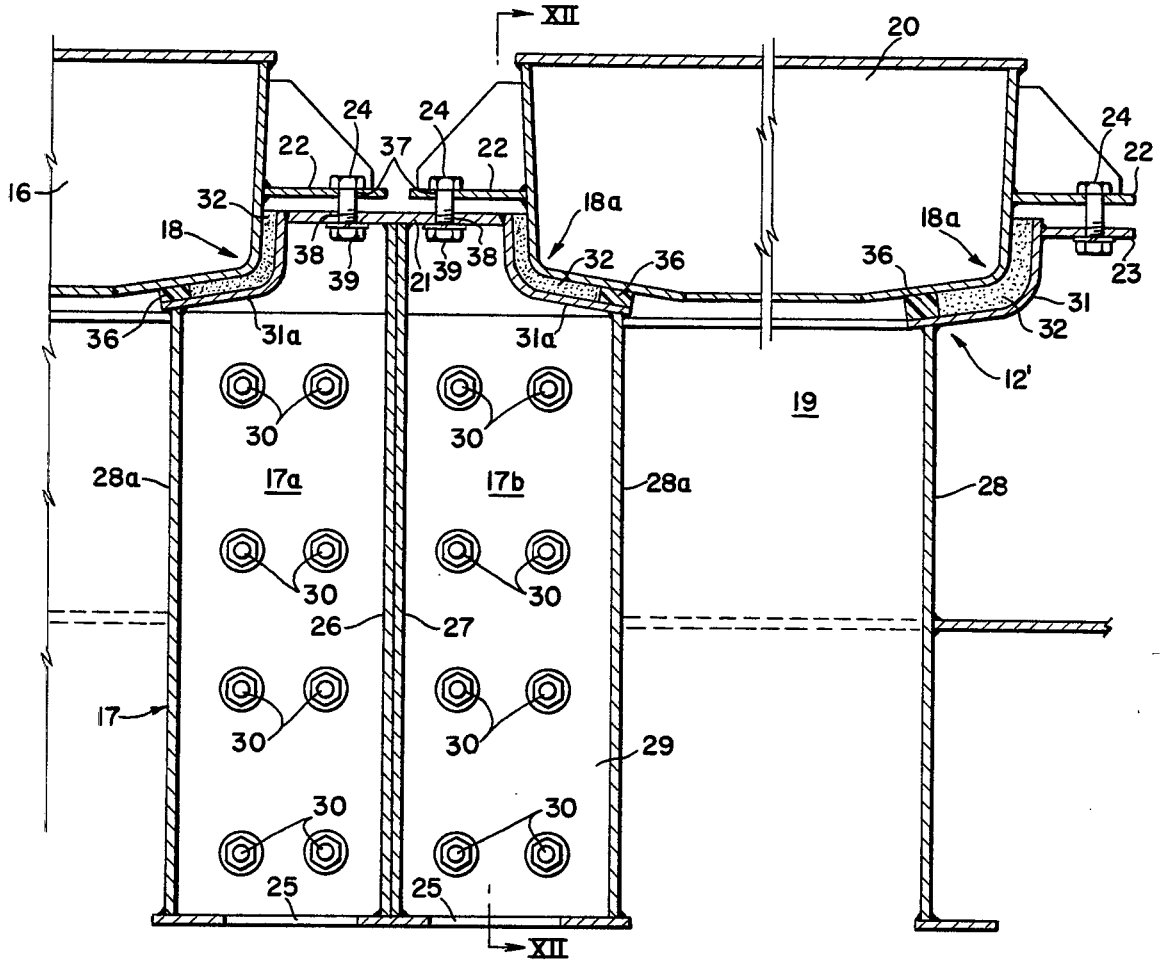
FIG. 10 is a partial cross section of an integral substructure of the invention with the intermediate member installed and the integral platform or cover installed.
Figure 11:
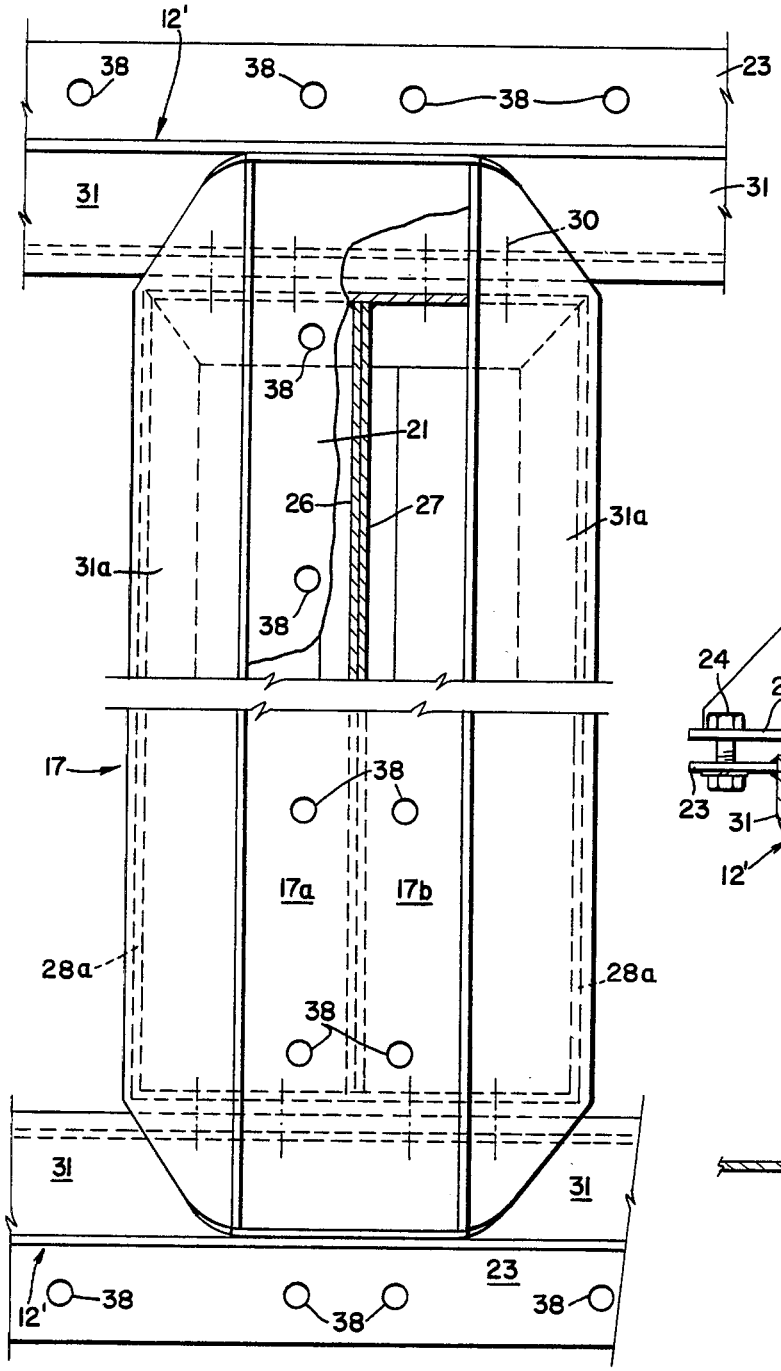
FIG. 11 is a top view of the object illustrated in FIG. 10 but without the platform and cover.

Particularly advantageous details of the system of the invention are shown in FIGS. 10–11.

According to these figures, all three integral substructure 12' (or 12 or 12'') are identical in design except for their longitudinal dimensions. The integral substructures 12, 12', 12'' have a cross section that forms a recess 31, which has a vertical part, an adjacent rounded part, and a region that drops somewhat obliquely inward and downward, and a vertical wall 28 joins this region at the bottom. In the region of the upper end of the recess 31, a counterflange 23 is attached outside and around it.

In accordance with the invention, an intermediate member 17, 17' is arranged between the opposite long sides (FIGS. 5, 7, 10–11) only in the two larger integral substructures 12' and 12'', and its ends have support regions **18*b*, which are complementary to the recess 31, and an end wall 29 lying opposite the vertical wall 28 of the integral substructure 12', 12''**.

According to FIG. 10, which illustrates the relationships existing in the integral substructure 12', the intermediate member 17 consists of two rigidly connected hollow beams **17*a*, 17*b*, which each have vertical side walls 26, 27, at which they are juxtaposed with each other. However, it is preferable to design the intermediate member 17 as a single unit, in which case only one partition is provided instead of walls 26, 27, and this partition is installed and preferably welded between the bottom and the flange plate 21**.

At its upper side edges, the intermediate member 17 has recesses **31*a*, which, as shown in FIG. 10, have the same configuration and arrangement as the recess 31 of the integral substructures 12', 12'' when the intermediate member 17 is installed. An upper horizontal flange plate 21 is situated between the two symmetrically arranged recesses 31*a* of the intermediate member 17. Vertical walls 28*a*, corresponding in shape and arrangement to the vertical walls 28 of the integral substructure 12'', join the recesses 31*a***.

The intermediate member 17', which is only indicated in FIg. 7, is of the same design as the intermediate member 17 shown in FIGS. 10 and 11 with regard to shape and arrangement of the support areas **18*b* and the recesses 31*a***.

Between the side walls 29 and the support regions **18*b* of the intermediate member 17 (17'') and the vertical walls 28 and recesses 31 of the integral substructures 12' (12'') is a space 32 filled with plastic, which hardens from an initial fluid state. A rigid bond between the end walls 29 and the vertical walls 28** is created with fastenings, for example, bolts.

The recesses **31*a* and the vertical wall 28*a*, which join it, for example, at its lowest portion, form miniaturized rectangular substructures with the recess 31 and the vertical wall 28 of the integral substructure 12'**

According to FIG. 10, the platform 16 of the next-smaller integral substructure 12 is arranged to the left of the intermediate member 17. In its marginal area, the platform 16 has a supporting area 18, which is convex and complementary in shape to the recess 31. The support area 18 therefore fits both in to the recess 31 of the integral substructure 12' and in to recess **31*a* of the intermediate member 17, as shown in detail in FIG. 10**.

In addition, the cover 20 is inserted into the opening 19 between the intermediate member 17 and one edge of the integral platform 12' and also has, in its lower marginal areas, convex support areas **18*a*, which are complementary to recesses 31 and 31*a*. The support areas 18, 18*a*, and the recesses 31, 31*a* are again spaced apart by sealing plastic material 32, which is initially a liquid, before it is hardened. The plastic is prevented from flowing out when injected, by means of elastic seals 36** which seal the bottoms of the spaces receiving the plastic.

Provided around the platform 16 and the cover 20 are horizontal flanges 22, which lie opposite the counterflanges 23 and the flange plate 21 at a short distance from them. By means of holes 37, 38, provided in the flanges or flange plate 21, bolts can be inserted, which are provided with nuts 39 and create the rigid bond between the integral substructure 12' and intermediate beam 17 on the one hand and the platform 16 and cover 20 on the other. The flange plate 21 therefore corresponds in shape and arrangement to the counterflange 23.

The hollow beams **17*a*, 17*b* have opening 25 on their bottoms, through which the bolts 24 and their nuts 39** can be manipulated.

Between the anchoring flanges 22 on the one hand and the counterflange 23 and flange plate 21 on the other, the adjustment means can also operate, which enable the platform 16 and/or the cover 20 to be positioned in accordance with the ship's datum plane before the liquid plastic 32 is introduced into recesses 31, as described in detail in German patent DE-PS No. 20 56 069.

While the positioning of the platform 16 and the cover 20 relative to the ship's datum plane can be fixed by the plastic seal 32 (FIG. 10) injected between the support areas 18 and **18*a* and the recesses 31 and 31*a*, the plastic seal 32 (FIG. 12) injected between the support area 18*b* of the intermediate member 17 and the recess 31 on the one hand and the end wall 29 and vertical wall 28 on the other, is used to compensate for any tolerances. In any case, the intermediate member 17 must be arranged in such a way that its recesses 31*a*, its vertical walls 28*a*, and its flange plate 21 form essentially an extension of recesses 31, vertical walls 28 and counterflanges 23 of the integral substructures 12' and 12''**.

Figure 12:
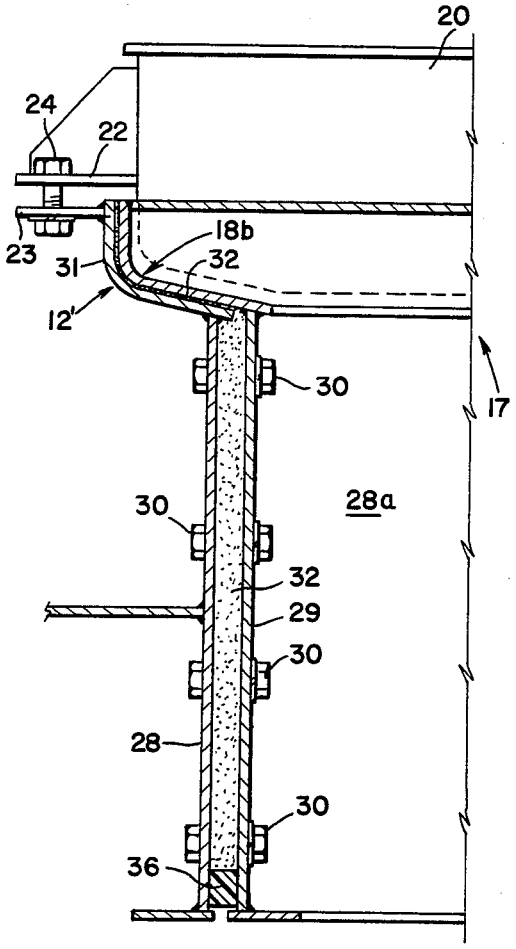
FIG. 12 is a part-section along line XII—XII in FIG. 11.

The assembly of an integral platform 16' and 16'' of the invention, using an intermediate member 17', proceeds as follows:

First, the intermediate member 17 is arranged at the site (FIG. 5) that forms the correct opening for the integral platform 16. As soon as the intermediate member 17 is positioned with the use of suitable auxiliary equipment, in such a way that its recess **31*a*, its vertical wall 28*a*, and its flange plate 21 comprise essentially an extension of recess 31, vertical wall 28 and counter flange 23 of the integral substructure 12', the interspace between the vertical wall and end wall is sealed off at the bottom and the sides by a seal 36. At the sides, the seal also extends upward through the interspace between the support area 18*b* and the recess 31 (FIG. 12). Then the interspace between the vertical wall 28 and the recess 31 on the one hand and the end wall 29 and support area 18*b* on the other are filled with liquid plastic. As soon as the plastic has set, the now fully adjusted bond between the integral substructure 12' and the intermediate member 17 is fixed with bolts 30**.

Thus, there are now essentially two miniaturized integral substructures into the larger of which the platform 16 is set crosswise and into the smaller of which the cover 20 is placed. After the integral platform 16 and, if necessary, the cover 20 are positioned relative to the ship's datum plane, the seals 36 are inserted, and the interspace between the support areas 18, **18*a* and the recesses 31, 31*a* is filled with plastic, so that after the plastic hardens, the adjusted position of the platform 16 and of the cover 20 is fixed. By means of bolts 24, the integral platform 16 and cover 20 are permanently mounted on the integral substructure 12' and the intermediate member 17**.

The invention is not to be taken as limited to all the details thereof described hereinabove, since modifications and variations thereof may be made without departing from the scope of the invention.

What is claimed is:

1. In combination, a ship-deck of an ocean going vessel, said deck having a plurality of rectangular mounting-openings, at least two of which are of different sizes, for receiving a corresponding rectangular base platform-structure, and at least one removable prefabricated equipment being mounted, in use, on its corresponding rectangular base platform-structure, which rectangular base platform-structure, in use, is disposed in its corresponding rectangular mounting-opening on said deck, said removable prefabricated equipment being of a type to include units such as weapon, fire-control, radar, lighting or navigational, and associated instrument control units, said combination providing an interchangeable mounting system wherein a relatively smaller rectangular base platform-structure can be mounted in a predetermined noncorresponding larger rectangular mounting-opening, the combination comprising:

at least one rectangular base platform-structure of a first size having a known length, substantially equal to L, and a known width, substantially equal to B;

said deck having at least one first size rectangular mounting-opening of dimensions substantially L and B, said at least one first size rectangular mounting-opening having a width side and a length side;

said at least one first size base platform-structure being dimensioned for mounting in a corresponding one of said at least one first size rectangular mounting-opening of dimensions L and B in said deck;

said length, substantially equal to L, being greater than said width, substantially equal to B;

at least one rectangular base platform-structure of a second size, larger than said first size, having a known length substantially equal to L′, and a known width, substantially equal to B′;

said deck having at least one second size rectangular mounting-opening of dimensions substantially L′ and B′, said at least one second size rectangular mounting-opening having a width side and a length side;

said at least one second size base platform-structure also being dimensioned for mounting in a corresponding one of said at least one second size rectangular mounting-opening of dimensions L′ and B′ in said deck;

said length, substantially equal to L′, being greater than said width, substantially equal to B′;

said length L of said first size rectangular mounting-opening being substantially equal to the width B′ of said second, larger, size rectangular mounting-opening, whereby one of said at least one first size rectangular base platform-structure is mountable with its base length along the width B′ of a larger second size rectangular mounting-opening, for obtaining mounting interchangeability, the combination including intermediate elongated supporting beam member means disposed in at least one of said at least one second size rectangular mounting-opening, said supporting beam means being disposed and bridging the width and parallel to said width side of its corresponding second size opening; and said ocean going vessel having at least one of said smaller rectangular base platform-structures disposed in one of said larger rectangular mounting-openings with the support beam means disposed and bridging the width thereof and supporting its smaller rectangular base platform-structure disposed thereinto.

2. A combination of a ship-deck and a mounting arrangement as in claim 1, including at least one third size rectangular unit with a platform-structure larger than said second size unit platform-structure and having a length, substantially equal to L″ and a width substantially equal to B″, the width B″ being equal to the length L′ of said second size.

3. A combination mounting arrangement as in claim 2, wherein the lengths and breadths of the three sizes of the rectangles are of the order of meters, and wherein the length and breadth of each of said three sizes of rectangles differ by about at least one meter.

4. A combination mounting arrangement as in claim 2, wherein the dimensions of the first, second and third sizes of rectangular base platforms are such that they have a length to width ratio, respectively, of 4 to 3, 5 to 4 and 6 to 5.

5. A combination mounting arrangement as in claim 1, wherein said single unfilled opening is provided with a rectangular cover.

6. A combination mounting arrangement as in claim 5, wherein said rectangular cover includes support regions which have a configuration similar to support regions of said first size rectangular base-structure mounted in said single unfilled opening.

7. A combination mounting arrangement as in claim 6 which includes recesses in said support regions of the rectangular cover, and the support regions of said first size rectangular base-structure, said support regions containing a sealing material which is disposed so as to facilitate levelling said first size rectangular base-structure and the rectangular cover before and during mounting.

8. A combination mounting arrangement as in claim 1 wherein an additional one of the smaller structures is mounted with a first of said at least smaller structure in their corresponding one of said larger rectangular mounting openings.

9. A combination mounting arrangement as in claim 8, wherein at least one selected base platform-structure mounted on the ship-deck includes equipment of the type to extend downwardly from a selected rectangular opening provided in the deck.

10. A combination mounting arrangement as in claim 1, wherein at least some rectangular openings have each an integral perimetrical substructure disposed underneath the deck surface which reinforcement functionally reinforces perimetrical areas of said rectangular openings.

11. A combination mounting arrangement as in claim 10, including fastening means at the ends of said intermediate beam to fasten said beam to the reinforcing substructure of an associated rectangular opening to improve rigidity.

12. A combination mounting arrangement as in claim 11, including plastic sealing material which is disposed at regions where said intermediate beam member is fastened to the reinforcing substructure.

13. A combination mounting arrangement as in claim 11, wherein said fastening means comprises bolts.

14. A mounting arrangement as in claim 13, wherein said intermediate beam member is of composite fabricated construction to comprise an upper flange plate, anchoring flanges and vertical side walls.

15. A mounting arrangement as in claim 14, wherein said intermediate beam member comprises two abutting hollow rectangular cross-sectioned beams each of which is fastened by bolts at end regions thereof to the reinforcing substructure of an associated rectangular opening in which said intermediate beam member is mounted.

16. A mounting arrangement as in claim 13, wherein said intermediate beam is substantially of integral construction.

17. In combination, a ship-deck of ocean going vessels and a mounting system on said ship-deck which has a plurality of rectangular openings, at least some of which are dimensionally dissimilar, for interchangeably mounting in said rectangular openings certain relocatable units;

said relocatable units comprising prefabricated equipment being mounted on different size rectangular base platform-structures shaped to be mounted in said rectangular openings on said ship-deck;

said rectangular openings each having peripheral reinforcing integral substructure;

said prefabricated equipment including units such as weapon, fire-control, radar and lighting and navigational units, and associated electronic/control equipment;

said mounting system facilitating mounting a relatively smaller rectangular base platform-structure of one of said relocatable units in a noncorresponding larger rectangular opening;

said mounting system including a plastic curable substance introduced, at least for levelling purposes, between a base platform-structure and its seating cooperating with an associated said peripheral reinforcing integral substructure, said mounting system comprising:

at least first and second different sizes of rectangular opening with substructure (12′ 12″), said first size rectangular opening having dimensions substantially equal to L by B and said second size rectangular opening, being larger than said first size rectangular opening, having dimensions substantially equal to L′ by B′, wherein B′ is substantially equal to L;

said combination including means to receive an intermediate elongated free-standing supporting beam member disposed in at least said second size rectangular opening, said supporting beam being mountable to bridge said second, larger, size rectangular opening in a direction parallel to the width of said second, larger, size rectangular opening; and said ocean going vessel having at least one of said smaller rectangular base platform-structures mounted in one of said at least one larger opening, said at least one larger opening having said support beam means mounted to bridge its width and support the smaller rectangular base platform-structure mounted therein.

18. System according to claim 17, wherein three integral substructures and (12, 12′, 12″) are provided, and wherein the width (B′, B″) of the next larger substructure is equal to the length (L, L′) of the next smaller substructure in each case.

19. System according to claim 18, wherein the length and width of each integral substructure (12, 12′, 12″) differ substantially by about one meter.

20. System according to claim 19, wherein the smallest integral substructure (12) has a length-width ratio of about 4 to 3.

21. System according to claim 20, wherein the second integral substructure (12′) has a length-width ratio of about 5 to 4.

22. System according to claim 21, wherein the third integral substructure (12″) has a length-width ratio of about 6 to 5.

23. System according to claim 22, wherein, when the system is used on ships (13, 14) of different sizes, smaller rectangular integral substructures (12) are assigned to the smaller ship (13) rather than to the larger ship (14).

24. System according to claim 23, wherein at least two rectangular integral substructures (12) of graduated size are provided on the same ship (15).

25. System according to claim 24, wherein a specific integral platform (16, 16′) intended for the next-smaller integral substructure (12, 12′), is installed crosswise in at least one of the larger integral substructures (12′, 12″).

26. System according to claim 25, wherein an intermediate member (17) is installed between the two long sides of the integral substructure (12′, 12″) to support the free long side of the integral platform (16, 16′), and its side facing the integral platform (16, 16′) is designed to correspond with the integral substructure (12′, 12″), and its end regions (18*b*) lying on the integral substructure (12′, 12″) are designed to correspond to the support areas (18) of the integral platform (16, 16′).

27. System according to claim 26, wherein the opening (19, 19′) remaining next to the integral platform (16, 16′) is covered by a rectangular cover (20, 20′).

28. System according to claim 27, wherein the support regions (18*a*) of the cover (20, 20′) are designed to correspond to the support regions (18) of the integral platform (16, 16′), and the side of the intermediate member (17, 17′) facing the cover (20, 20′) is designed to correspond to the integral substructure (12′, 12″).

29. System according to claim 25, wherein intermediate member (17) is of a width such that the integral substructure is provided on its upper longitudinal edges, and the two end regions (18*b*) designed to correspond to the support area (18) of the integral platform (16, 16′), are arranged between them.

30. System according to claim 29, wherein the cover (20, 20′) also supports a said functional unit.

31. System according to claim 30, wherein the intermediate member (17) has an upper flange plate (21), and anchoring flanges (22) are provided on the integral platform (16) or in the cover (20) around it and face the flange plate (21), said anchoring flanges (22) arranged around the integral substructure (12′, 12″) in such a way that the anchoring flanges (22) can be connected with the flange plate by bolts (24).

32. System according to claim 31, wherein intermediate member (17), which consists of a single piece, is hollow and has mounting apertures (25) at the bottom, and wherein intermediate member (17), consisting of a single piece, has two axial cavities (17*a*, 17*b*) between which flat vertical partitions (26, 27) are arranged, and which have symmetrical cross-sections relative to the partitions (26, 27).

33. System according to claim 32, wherein the intermediate member (17) has essentially a height corresponding to the height of a vertical wall (28) provided on the integral substructure (12', 12''), and end walls (29) that can be attached to the vertical wall (28) by bolts (30).

34. System according to claim 33, wherein the integral substructure (12, 12', 12''), has recesses (31) into which the convex support areas (18, 18*a*, 18*b*) of the integral platform (16, 16') are formed complementary to the recesses (31) and extend into them, with the plastic layer sandwiched (32) between them.

35. In combination, a ship-deck of an ocean going vessel, said deck having a plurality of rectangular mounting-openings, at least two of which are of different sizes, for receiving a corresponding rectangular base platform-structure, and at least one removable prefabricated equipment being mounted, in use, on its corresponding rectangular base platform-structure, which rectangular base platform-structure, in use, is disposed in its corresponding rectangular mounting-opening on said deck, said removable prefabricated equipment being of a type to include units such as weapon, fire-control, radar, lighting or navigational, and associated instrument control units, said combination providing an interchangeable mounting system wherein a relatively smaller rectangular base platform-structure can be mounted in a predetermined noncorresponding larger rectangular mounting-opening, the combination comprising:

at least one rectangular base platform-structure of a first size having a known length, substantially equal to L, and a known width, substantially equal to B;

said deck having at least one first size rectangular mounting-opening of dimensions substantially L and B, said at least one first size rectangular mounting-opening having a width side and a length side;

said at least one first size base platform-structure being dimensioned for mounting in a corresponding one of said at least one first size rectangular mounting-opening of dimensions L and B in said deck;

said length of said first size base platform-structure, substantially equal to L, being greater than said width of said first size base platform-structure, substantially equal to B;

said deck having at least one second size rectangular mounting-opening, larger than said first size rectangular mounting-opening, of dimensions substantially L' and B', said at least one second size rectangular mounting-opening having its width side substantially equal to B' and its length side substantially equal to L';

said at least one second size rectangular mounting-opening for receiving a corresponding second size base platform-structure, which structure is dimensioned to have a known length substantially equal to L', and a known width substantially equal to B', said second size base platform-structure for being mountable in said at least one second size rectangular mounting-opening of dimensions L' and B' in said deck;

said length, of said second size rectangular mounting-opening, substantially equal to L', being greater than said width thereof, substantially equal to B';

said length L of said first size rectangular mounting-opening being substantially equal to the width B' of said second, larger, size rectangular mounting-opening, whereby one of said at least one first size rectangular base platform-structure is mountable with its base length along the width B' of a larger second size rectangular mounting-opening, for obtaining mounting interchangeability, the combination including elongated mounting-opening beam means disposed in at least one of said at least one second size rectangular mounting-opening, said supporting beam means being disposed and bridging the width and parallel to said width side of its corresponding second size opening; and said ocean going vessel having at least one of said smaller rectangular base platform-structures disposed in one of said larger rectangular mounting-openings with the support beam means disposed and bridging the width thereof and supporting its smaller rectangular base platform-structure disposed thereinto.

* * * * *